United States Patent [19]

Smart et al.

[11] Patent Number: 4,773,869

[45] **Date of Patent: * Sep. 27, 1988**

[54] ELECTRIC WALL UNIT

[76] Inventors: Nancy M. Smart, Rte. 2, Box 238, Contoocook, N.H. 03229; Ricky B. Smart, P.O. Box 238, Concord, N.H. 03301

[ * ] Notice: The portion of the term of this patent subsequent to Sep. 2, 2004 has been disclaimed.

[21] Appl. No.: 52,080

[22] Filed: May 21, 1987

Related U.S. Application Data

[62] Division of Ser. No. 847,942, Apr. 3, 1986, Pat. No. 4,690,474.

[51] Int. Cl.[4] ..... H01R 19/16

[52] U.S. Cl. ..... 439/120; 439/121; 439/209

[58] Field of Search ..... 439/110-122, 439/207-216, 650-652

[56] References Cited

U.S. PATENT DOCUMENTS

| | | | |
|---|---|---|---|
| 1,929,547 | 10/1933 | Cassidy | 439/115 |
| 2,041,344 | 5/1936 | James | 439/120 |
| 2,316,072 | 4/1943 | Judisch | 439/651 |
| 2,579,854 | 12/1951 | Perkins | 439/115 |
| 2,673,967 | 3/1954 | Hedgecock | 439/120 |
| 3,081,442 | 3/1963 | Platz | 439/94 |
| 3,337,697 | 8/1967 | Martin et al. | 191/23 R |

FOREIGN PATENT DOCUMENTS

| | | | |
|---|---|---|---|
| 1911315 | 7/1970 | Fed. Rep. of Germany . | |
| 1930515 | 2/1971 | Fed. Rep. of Germany . | |
| 558476 | 6/1958 | Canada | 439/119 |
| 2067363 | 7/1981 | United Kingdom . | |

*Primary Examiner*—Gil Weidenfeld
*Assistant Examiner*—Gary F. Paumen
*Attorney, Agent, or Firm*—Wolf, Greenfield & Sacks

[57] ABSTRACT

An electric wall unit which is engaged by sliding a plug to the inner end of a passage in a wall outlet.

2 Claims, 3 Drawing Sheets

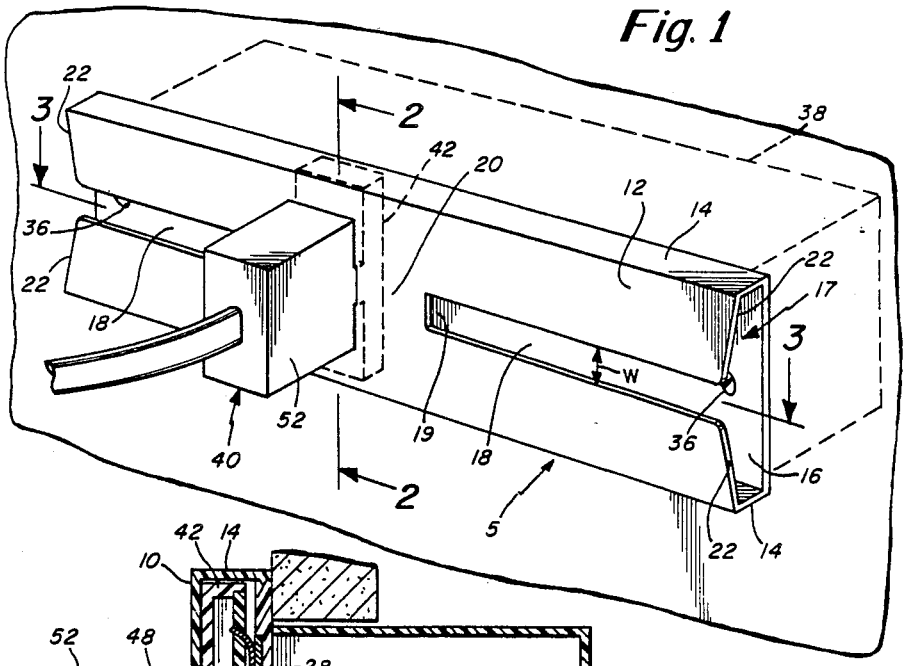
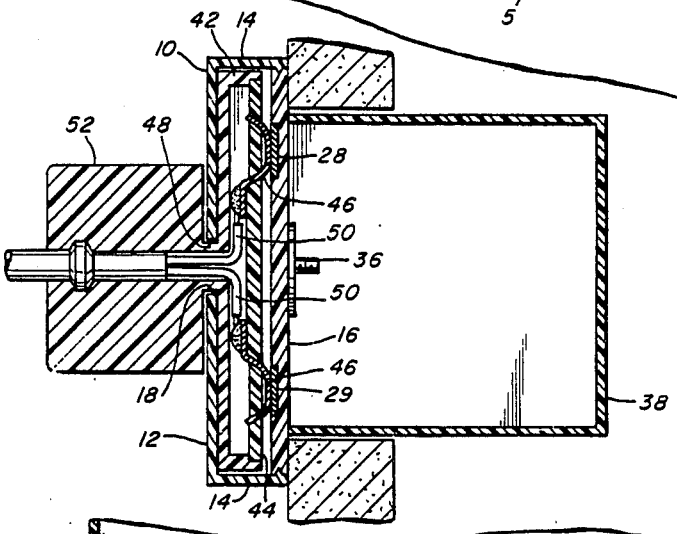
Fig. 2
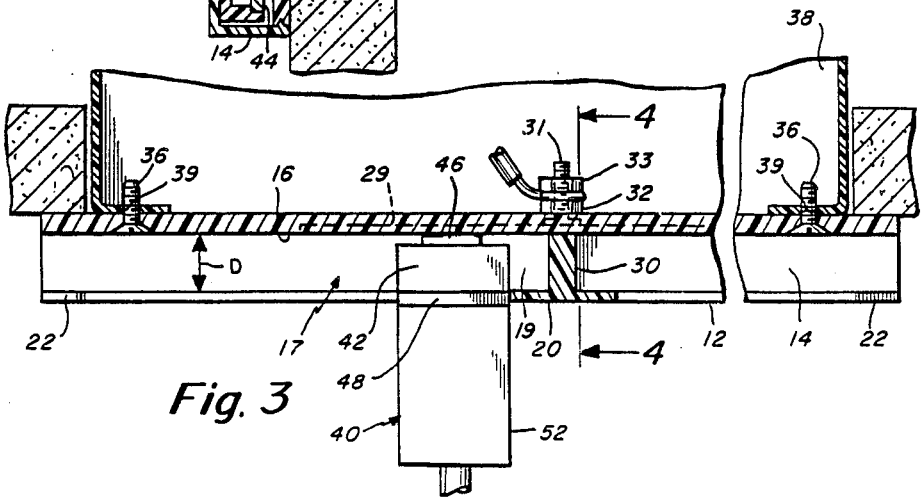
Fig. 3

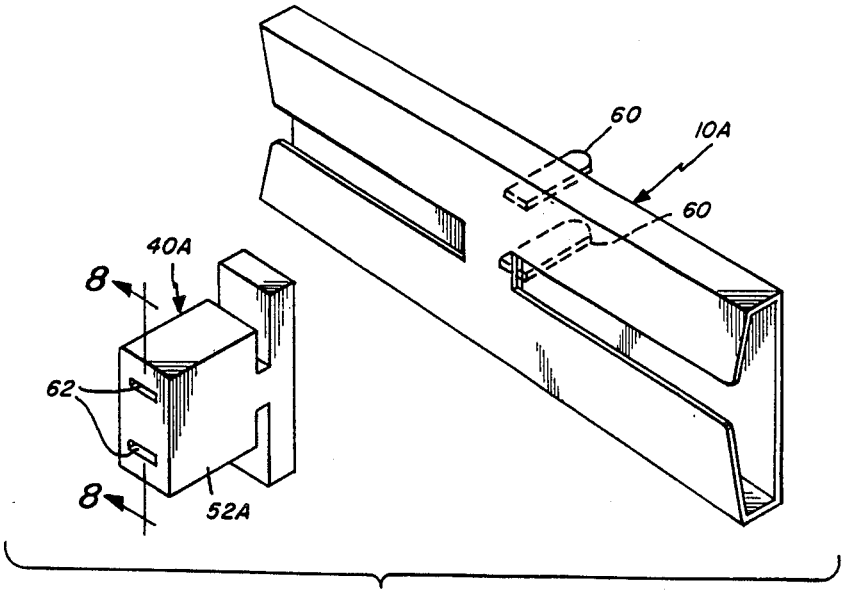
Fig. 7
Fig. 8
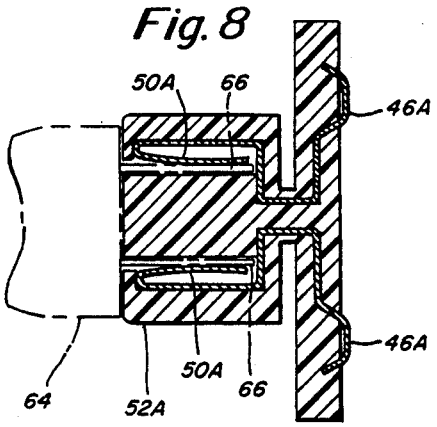

ELECTRIC WALL UNIT

This application is a division of application Ser. No. 847,942, filed Apr. 3, 1986, now U.S. Pat. No. 4,690,474, issued Sept. 1,1987.

BACKGROUND OF THE INVENTION

Common electric wall units consist of a socket having two or three holes in which the prongs of a plug are inserted. The structure of this socket-plug configuration poses a safety threat to children or others who may get burned or shocked upon sticking a metal object or fingers in the socket. This is a particular danger to blind people who must deal with their fingers to find the holes in a socket.

Another problem is that plugs are often difficult to remove from a socket because of a tight fit. Often the person having difficulty will twist the plug to loosen it or will pull on the wire to gain leverage. In both cases, damage to the plug by exposing a wire may result.

SUMMARY OF THE INVENTION

It is a general object of the present invention to provide an electric wall unit which is safe and easy to use.

It is a more particular object of the present invention to provide a wall unit which eliminates the danger of injury or shock.

It is a further object of the invention to provide an electric wall unit which does not require great physical exertion to disengage.

The invention provides an electric wall unit having a wall outlet and a plug. The wall outlet has an interior passage in which the base of the plug is slidable. A pair of electrically conductive strips are secured to the bottom of the outlet and are connected to live wires in the wall. The base of the plug has a pair of electric contacts which touch the conductive strips of the outlet when the plug is fully inserted in the wall outlet. The contacts are attached to wires which connect the plug to the electrical appliance. The unit can be engaged or disengaged by sliding the plug in or out of the passage in the wall outlet.

BRIEF DESCRIPTION OF THE DRAWINGS

These and other objects and advantages of the present invention will be more clearly understood from the following description with reference to the accompanying drawing in which:

FIG. 1 is a perspective view of an electric wall unit embodying the present invention;

FIG. 2 is a view of the wall outlet taken along lines 2—2 of FIG. 1;

FIG. 3 is a view of the wall outlet taken along lines 3—3 of FIG. 1;

FIG. 7 is a perspective view of another embodiment of an electric wall outlet and plug in accordance with the invention; and FIG. 8 is a cross sectional view taken along lines 8—8 of FIG. 7.

DETAILED DESCRIPTION OF THE DRAWINGS

Figure 4:
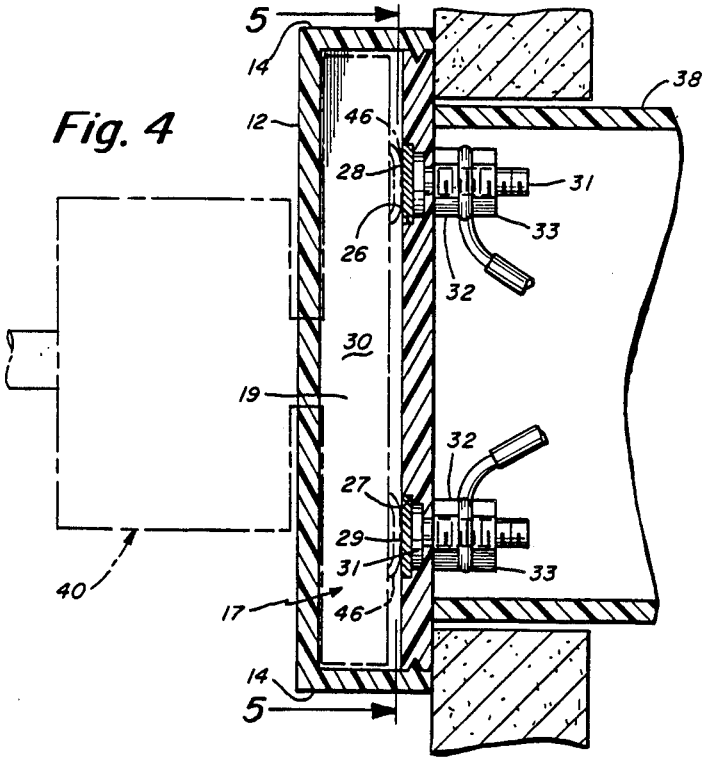
FIG. 4 is a view of the wall unit taken along lines 4—4 of FIG. 3.

The electric wall unit of the invention shown in FIG. 1 comprises a wall outlet 5 and a plug 40. The unit is intended to be used on a wall as a means for connecting live wires with the outlet cords of electrical appliances.

The wall outlet 5 is generally rectangular having a top surface 12, sidewalls 14, and a bottom surface 16 which define a passage 17. The depth D of the passage 17 is less than $\frac{1}{4}$ inch thereby preventing insertion of a finger in the passage 17. The longitudinal ends 22 of the top surface 12 may be tapered to facilitate insertion of the plug 40 within the wall outlet. Although the preferred embodiment of the the wall outlet 5 is rectangular as shown, other shapes such as circles, hexagons, etc. may be used to provide simultaneous access to more appliances. The wall outlet 5 is preferably made of molded plastic but other electrically insulative materials may be used.

The top surface 12 of the wall outlet 5 has a horizontal slot 18 which extends from the center 20 of the top surface 12 to the longitudinal ends 22. The slot 18 is narrow, having a width W of approximately $\frac{1}{4}$ inch so as to prevent the insertion of a finger in the slot 18. The preferred embodiment as shown in FIG. 1 has a pair of opposing horizontal slots 18.

As shown in FIG. 2, the bottom surface 16 of the wall outlet 5 has grooves 26, 27 in which rigid electrically conductive strips 28, 29 are fitted. The strips 28, 29 serve as electrodes and are preferably made of brass or copper. The strips 28, 29 are secured in the grooves 26, 27 by a central wall 30 which is perpendicular to and connects sidewalls 14. The central wall 30 is located in the middle of the wall outlet 10 dividing it into two laterally reversed but otherwise identical sections. A first screw 31 is positioned under each of the strips 28, 29 and extends downwardly through the bottom surface 16 of the wall outlet 5. The screw 31 is secured to the bottom surface 16 by a first nut 32. Each screw 31 is connected to a live wire (not shown) which is secured to the screw 31 by means of a second nut 33. The wall outlet 5 is affixed to a conventional wall box 38 by means of a pair of second screws 36 which are threaded into holes 39 in the wall box.

As shown in FIG. 4, the plug 40, may be inserted into the wall outlet 5. The plug 40 has a base 42 which has a width WB which is slightly less than the width WF of the wall outlet 5 since the base 42 must be able to easily fit in the passage 17 of the wall outlet 5. The base 42 is preferably rectangular to facilitate easy sliding of the plug 40 within the passage 17 but other shapes may be used.

Figure 5:
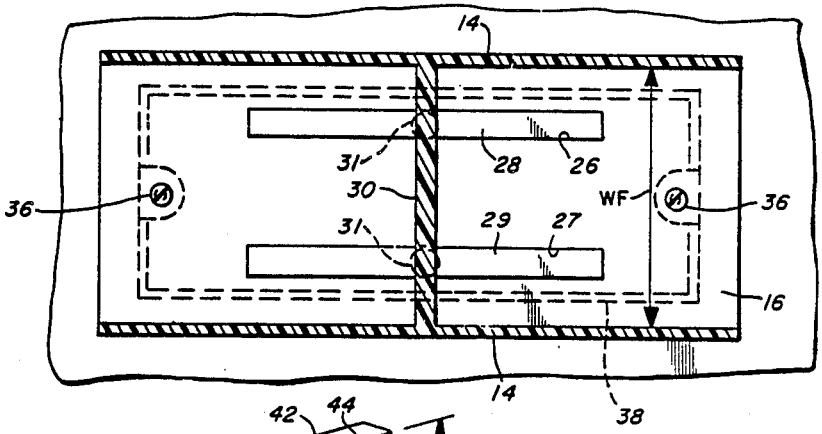
FIG. 5 is a view of the wall unit taken along lines 5—5 of FIG. 4.

As shown in FIG. 5, the bottom surface 44 of the base 42 has two electrical contacts 46 which are aligned with and touch the conductive strips 28, 29 when the plug 40 is inserted in the wall outlet 5 and slid in the passage 17 from the peripheral edge 22 of the wall outlet to the inner end 19 of the passage. The contacts 46 have a spring torsion which exerts pressure on the bottom surface 16 of the wall outlet 10 to prevent accidental slippage of the plug 40. The contacts 46 are composed of good electrical conductors such as copper or brass.

Figure 6:
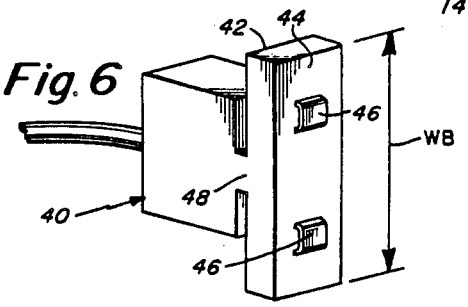
FIG. 6 is a perspective view of the plug.

A neck 48 extends upwardly from the base 42 of the plug 40. The neck 48 is sized so as to be able to extend through the slot 18 in the top surface 12 of the wall outlet 5. The neck 48 may be rectangular, cylindrical or any other shape which allows unimpeded movement of the neck 48 within the slot 18. As shown in FIG. 6, wires 50 extend from the contacts 46 upwardly through the neck 48.

In the preferred embodiment, the neck 48 is integrally connected to a handle 52. When the plug 40 is inserted into the wall outlet 5, the handle 52 extends above the top surface 12 of the wall outlet 5 and can be grasped to facilitate insertion or removal of the plug 40. Wires 50 extend through the handle 52 to form the outlet cord 49. The handle 52 is preferably rectangular or cylindrical but may be any shape which is easily grasped. The base 42, neck 48 and handle 52 of the plug 40 are made of plastic by blow-molding.

Alternate embodiments of the invention for use with conventional sockets and plugs are shown in FIGS. 7 and 8. In order to facilitate insertion of the invention into a conventional two-prong 110 volt socket (not shown), the wall outlet 10A is modified by replacing the screws 31 with prongs 60. The plug 40 may then be used with the wall outlet 10A.

In order to use the invention with a conventional plug 64, the handle 52A of the plug 40A, has apertures 62 sized to accept the prongs 66 of the conventional plug 64. Each of a pair of conductive strips 50A extends from the electric contacts 46A into opposing sides of the handle 52A of the plug 40A. The strips 50A are positioned so as to contact the prongs 66 of the conventional plug inserted in the plug 40A.

The above described embodiments are just examples of the present invention, and therefore, it will be apparent to those skilled in the art that many modifications and variations may be made without departing form the spirit of the invention.

What is claimed is:

1. An electric wall unit, comprising a wall outlet having a top surface, sidewalls, and a bottom surface which define an interior passage, the top surface of said wall outlet having a lateral slot extending from the center to a longitudinal end of said top surface, a first electrical conductor secured to the bottom surface of said wall outlet, means for securing said first conductor to said wall outlet, means for connecting said first conductor to a live electrical wire, and means for attaching said wall outlet to a wall; and a plug having a base shaped and sized so as to slidably fit in said passage, a second electrical conductor secured to the bottom of said base, said second conductor contacting said first conductor when said plug is slid to an inner end of said passage, a neck which extends upwardly from said base, said neck having a width less than the width of said slot, wherein said second conductor contacts said first conductor when said plug is slid in said passage from said longitudinal end of the wall outlet to an inner end of the passage, said outlet and plug being shaped so that said plug can only be inserted into said outlet in a direction parallel to the longitudinal axis of the outlet and not in a direction normal to said longitudinal axis, a handle which is integrally connected to said neck, said handle having a pair of apertures, each of said apertures sized and shaped so as to snugly receive the prong of a conventional plug, said neck having a conductive strip, said conductive strip being so positioned so as to contact a prong of a conventional plug inserted in the plug, and a conductive portion which connects said second conductor to said conductive strip.

2. An electric wall unit according to claim 1 comprising a pair of said conductive strips and wherein said second conductor comprises a pair of opposing electric contacts, each of said contacts being attached to a separate said conductive portion which is connected to a separate said conductive strip.

* * * * *